US009044063B2

(12) United States Patent
Loverin et al.

(10) Patent No.: US 9,044,063 B2
(45) Date of Patent: Jun. 2, 2015

(54) INFANT FOOTWEAR

(75) Inventors: Marc Loverin, Scituate, MA (US); Dana Garczewski, Watertown, MA (US)

(73) Assignee: SRL, LLC, Lexington, MA (US)

( * ) Notice: Subject to any disclaimer, the term of this patent is extended or adjusted under 35 U.S.C. 154(b) by 508 days.

(21) Appl. No.: 13/473,264

(22) Filed: May 16, 2012

(65) Prior Publication Data

US 2013/0305566 A1 Nov. 21, 2013

(51) Int. Cl.

| | |
|---|---|
| ***A43B 1/10*** | (2006.01) |
| ***A43C 11/00*** | (2006.01) |
| ***A43B 3/30*** | (2006.01) |
| ***A43B 11/00*** | (2006.01) |
| ***A43B 23/04*** | (2006.01) |
| ***A43C 11/14*** | (2006.01) |

(52) U.S. Cl.

CPC . *A43B 3/30* (2013.01); *A43B 11/00* (2013.01); *A43B 23/047* (2013.01); *A43C 11/1493* (2013.01)

(58) Field of Classification Search

CPC ..... A43B 3/30; A43B 3/26; A43B 23/047; A43B 11/00; A43B 23/045; A43B 23/0265; A43B 23/027; A43B 23/028; A43B 23/0295; A43C 23/047

USPC ..... 36/112, 113, 114, 50.1, 88, 93

See application file for complete search history.

(56) References Cited

U.S. PATENT DOCUMENTS

| | | | | | |
|---|---|---|---|---|---|
| 797,966 | A | * | 8/1905 | Lange et al. | 36/8.2 |
| 1,123,245 | A | | 1/1915 | Chesbrough | |
| 2,513,005 | A | * | 6/1950 | Crawford | 36/11.5 |
| 2,619,744 | A | * | 12/1952 | Mattes | 36/105 |
| 2,919,503 | A | | 1/1960 | Sholovitz | |
| 3,106,790 | A | | 10/1963 | Zimmon | |
| 3,389,481 | A | * | 6/1968 | England | 36/97 |
| 4,120,103 | A | * | 10/1978 | Colby | 36/97 |

(Continued)

FOREIGN PATENT DOCUMENTS

| | | |
|---|---|---|
| AT | 6841 | 5/2004 |
| DE | 1931800 | 3/1970 |

(Continued)

OTHER PUBLICATIONS

International Search Report, PCT/US2013/037044 dated Jul. 26, 2013.

(Continued)

*Primary Examiner* — Jila M Mohandesi

(74) *Attorney, Agent, or Firm* — Warner Norcross & Judd LLP

(57) ABSTRACT

An article of infant footwear includes a sole made of a flexible, compliant layer of material with a thickness of between about 1 mm and about 3 mm. The article of infant footwear includes an upper attached to the sole, the upper and the sole together define a void to receive a foot. The upper has a heel cap independently movable relative to a remaining portion of the upper. The article of infant footwear further includes lateral and medial expanders. The lateral expander has a first end attached to a lateral heel portion of the upper and a second end attached to the heel cap. The medial expander has a first end attached to a medial heel portion of the upper and a second end attached to the heel cap. Each expander independently moves between a relaxed state and a stretched state to accommodate receipt of the infant foot.

18 Claims, 7 Drawing Sheets

(56) References Cited

U.S. PATENT DOCUMENTS

| | | | | | |
|---|---|---|---|---|---|
| D253,316 | S | | 11/1979 | Hull | |
| 4,314,412 | A | | 2/1982 | Anderson et al. | |
| D274,290 | S | | 6/1984 | Migdow | |
| D274,291 | S | | 6/1984 | Migdow | |
| D274,672 | S | | 7/1984 | Garrett | |
| 4,489,509 | A | * | 12/1984 | Libit | 36/7.1 R |
| 4,773,170 | A | | 9/1988 | Moore et al. | |
| 4,944,099 | A | * | 7/1990 | Davis | 36/97 |
| 5,052,128 | A | | 10/1991 | Lonardo | |
| 5,176,624 | A | | 1/1993 | Kuehnreich | |
| 5,354,260 | A | | 10/1994 | Cook | |
| 5,575,013 | A | | 11/1996 | Krack | |
| D385,039 | S | | 10/1997 | Kesting et al. | |
| 5,682,687 | A | * | 11/1997 | Arai | 36/97 |
| 5,956,868 | A | * | 9/1999 | Stevens et al. | 36/8.3 |
| D454,395 | S | | 3/2002 | Stephens | |
| 7,017,287 | B2 | | 3/2006 | Allen | |
| 7,055,268 | B2 | * | 6/2006 | Ha | 36/97 |
| 2008/0110049 | A1 | | 5/2008 | Sokolowski et al. | |
| 2008/0148605 | A1 | | 6/2008 | Edgeworth et al. | |
| 2009/0019736 | A1 | * | 1/2009 | Ng et al. | 36/25 R |
| 2009/0217552 | A1 | | 9/2009 | Paintin et al. | |
| 2009/0272010 | A1 | | 11/2009 | Loverin | |
| 2010/0011621 | A1 | | 1/2010 | Malka-Harari | |
| 2013/0276332 | A1 | * | 10/2013 | Malka-Harari | 36/97 |

FOREIGN PATENT DOCUMENTS

| | | | |
|---|---|---|---|
| EP | 43379 | A1 | 1/1982 |
| EP | 468347 | A1 | 1/1992 |
| GB | 2367477 | A | 4/2002 |
| JP | 11075901 | A | 3/1999 |
| JP | 2007296081 | A | 11/2007 |
| KR | 2000050034 | A | 8/2000 |
| WO | WO-8101948 | A1 | 7/1981 |
| WO | WO-2009134598 | A2 | 11/2009 |
| WO | WO-2010011275 | A1 | 1/2010 |

OTHER PUBLICATIONS

Written Opinion, PCT/US2013/037044 dated Jul. 26, 2013.

* cited by examiner

INFANT FOOTWEAR

TECHNICAL FIELD

This disclosure relates to infant footwear.

BACKGROUND

In general, shoes, a type of articles of footwear, include an upper secured to a sole. The upper and the sole together define a void that is configured to hold a human foot. Often, the upper and/or the sole are/is formed from multiple layers that can be stitched or adhesively bonded together. For example, the upper portion can be made of a combination of leather and fabric, or foam and fabric, and the sole can be formed from at least one layer of natural rubber. Often materials are chosen for functional reasons, e.g., water-resistance, durability, abrasion-resistance, and breathability, while shape, texture, and color are used to promote the aesthetic qualities of the shoe.

SUMMARY

This disclosure provides an article of footwear that compliments the changing size and shape of an infant foot by providing an adjustable fit around the infant foot (e.g., by swaddling the infant foot). Moreover, the infant footwear promotes complimentary movement and/or proprioceptive feedback of the infant's foot for a range of activities that may include walking, crawling, standing, turning, cruising (e.g., walking while holding onto a support object), climbing, etc. An infant relies on the sensations felt by his/her feet to learn to walk and an article of footwear that promotes, rather than masks, translation of the ground contours and contact forces helps the infant learn to walk while still providing a protective covering over the infant's foot. Therefore, the article of footwear needs to be flexible for bending with the foot and the sole needs to be thin enough to allow translation of ground contact forces. Besides providing a protective covering, the article of footwear may also provide a certain degree of stability and agility to the infant's foot, such as ground contact conformability, bending, complimentary movement, and a proper fit around the infant foot.

One aspect of the disclosure provides an article of infant footwear. The article of footwear includes a sole made of a flexible, compliant layer of material with a thickness between about 1 mm and about 3 mm. The footwear article also includes an upper attached to the sole, the upper and the sole together define a void to receive an infant foot. The upper has a heel cap that independently moves relative to a remaining portion of the upper. The footwear article further includes lateral and medial expanders. The lateral expander has a first end attached to a lateral heel portion of the upper and a second end attached to the heel cap. The medial expander has a first end attached to a medial heel portion of the upper and a second end attached to the heel cap. Each expander independently moves between a relaxed state and a stretched state to accommodate receipt of the infant foot.

Implementations of the disclosure may include one or more of the following features. In some implementations, the upper defines lateral and medial pockets in the corresponding lateral and medial heel portions of the upper. The pockets are arranged to receive the corresponding lateral and medial expanders. Each pocket may substantially fully receive the corresponding expander in its relaxed state. The heel cap may abut the remaining portion of the upper, and conceal the expanders, when the expanders are in their relaxed states. Each expander moves out of its corresponding pocket when moving from its relaxed state to its stretched state. The upper may have an outer layer disposed on an inner layer, where the inner and outer layers define the lateral and medial pockets. A lower end portion of the heel cap may connect to the sole, allowing the heel end to pivot about its lower end. Alternatively, a lower end portion of the heel cap may move freely relative to the sole. A closure with a first end attached to one of a lateral portion and a medial portion of the upper and a free second end is releasably securable to the other of the lateral and medial portions of the upper. The closure moves between an open position and a closed position. The open position exposes the void which is defined by the upper and the sole, and the closed position secures the received infant foot in the void. Furthermore, a hook and loop fasteners may be arranged for releasably securing the closure. The sole may be made with, but not limited to, a fabric and/or a leather material.

Another aspect of the disclosure provides an upper for an article of infant footwear. The upper includes a heel cap which moves independently relative to a remaining portion of the upper. The upper further includes lateral and medial expanders. The lateral expander has a first end attached to a lateral heel portion of the upper and a second end attached to the heel cap. The medial expander has a first end attached to a medial heel portion of the upper and a second end attached to the heel cap. Each lateral expander independently moves between a relaxed state and a stretched state to accommodate receipt of an infant foot. The upper further includes a closure with a first flap and a second flap. The first flap extends from one of a lateral portion and a medial portion of the upper, and the second flap extends from the other of the lateral and medial portions of the upper. The first and second flaps overlap and releasably attach to each other for securing the received infant foot.

Implementations of the disclosure may include one or more of the following features. In some implementations the upper defines lateral and medial pockets in the corresponding lateral and medial heel portions of the upper. The pockets are arranged to receive the corresponding lateral and medial expanders. Each pocket may substantially fully receive the corresponding expander in its relaxed state. The heel cap may abut the remaining portion of the upper, and conceal the expanders, when the expanders are in their relaxed states. Each expander moves out of its corresponding pocket when moving from its relaxed state to its stretched state. The upper may have an outer layer disposed on an inner layer, where the inner and outer layers defining the lateral and medial pockets. The heel cap may pivot about a lower end portion of the heel cap. Alternatively, upper and lower portions of the heel cap may move freely relative to the remaining portion of the upper. The first and second flaps may overlap in a swaddling configuration. Furthermore, hook and loop fasteners may be arranged for releasably securing the first and second flaps of the closure together. At least one of the first and second flaps may extend between a foot opening defined by the upper and a toe box portion of the upper.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
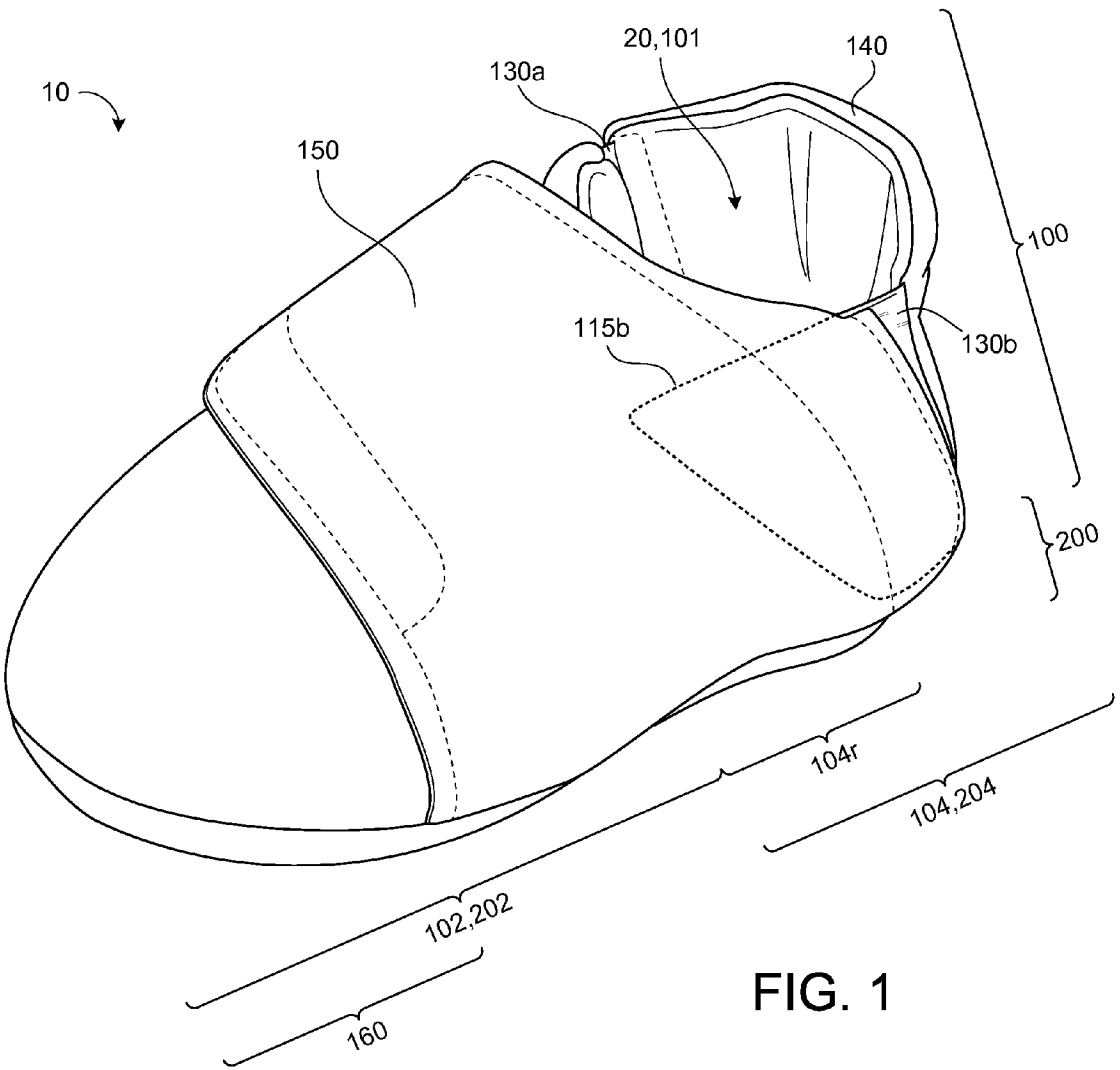
FIG. 1 is front perspective view an exemplary article of infant footwear having a heel portion expander in an unexpanded state.

Infants (e.g., babies) have substantially rounded feet, unlike adolescents and adults whom have relatively elongated feet with pronounced arch development. Infants generally experience relatively quick muscle growth and coordination development. As a result, the size and shape of an infant's foot can change relatively quickly. An infant learns to walk and develops a gait through coordination development and receiving proprioceptive feedback from nerve endings in its feet. The most influential time for gait development is between about 9 and 24 months of age. As a result, an infant shoe configured to allow or promote complimentary movement and proprioceptive feedback while donned on an infant's foot will likely aid the infant in learning to walk, development of a natural gait, and reduce stubbles and falls. Furthermore, an infant shoe configured to cradle and swaddle around an infant's foot and mimic the infant foot shape is advantageous, for movement, comfort, and fit.

Referring to FIGS. 1-7, in some implementations, an article of infant footwear 10 includes an upper 100 attached to a sole 200 (e.g., by stitching and/or an adhesive). Together, the upper 100 and the sole 200 define a foot void 20 configured to securely and comfortably hold an infant foot. The upper 100 defines a foot opening 101 for receiving a human foot into the foot void 20. The upper 100 and the sole 200 each have a corresponding forefoot portion 102, 202 and a corresponding heel portion 104, 204. Moreover, the upper 100 and the sole 200 each have a corresponding lateral portion 106, 206 and a corresponding medial portion 108, 208.

The upper 100 may include one or more layers of materials. In the example shown, the upper 100 includes an outer layer 110 (e.g., made of leather) disposed on an inner layer 120 (e.g., a lining made of fabric). The outer layer 110 may be connected (e.g., stitched, glued, etc.) to the inner layer 120. A fabric is a textile or cloth made by weaving, knitting, or felting fibers. A woven fabric includes a network of natural or artificial fibers often referred to as thread or yarn. A nonwoven fabric is a fabric-like material made from fibers autogenously bonded together by a chemical, mechanical, heat or solvent treatment. For example, a felt, which is neither woven nor knitted, is a nonwoven fabric. Nonwoven materials typically lack strength unless densified or reinforced by a backing material. Leather is a durable and flexible material created by the tanning of putrescible animal rawhide and skin, primarily cattle hide.

Referring to FIGS. 1-6, in some implementations, the heel portion 104 of the upper 100 includes lateral and medial expanders 130*a*, 130*b* that allow corresponding lateral and medial portions 106, 108 of the upper 100 in the heel portion 104 to independently expand and lengthen to accommodate different sized infant feet. The expanders 130*a*, 130*b* allow a heel cap 140 to move relative to a remaining heel portion 104*r* of the upper 100. Each expander 110*a*, 110*b* may be made of an elastic material, such as a stretch fabric, to move between relaxed and stretched states. A stretch fabric is a synthetic fabric that stretches in one or more directions. 2-way stretch fabrics stretch in one direction, usually from selvedge to selvedge (but can be in other directions depending on the knit), whereas 4-way stretch fabrics, such as spandex, stretch in both directions, crosswise and lengthwise. The expanders 130*a*, 130*b* allow the heel cap 140 to move to accommodate donning the article of infant footwear 10 on an infant foot as well to retain the footwear article 10 on the infant foot (e.g., to prevent the infant from kicking off the footwear article 10).

Figure 2:
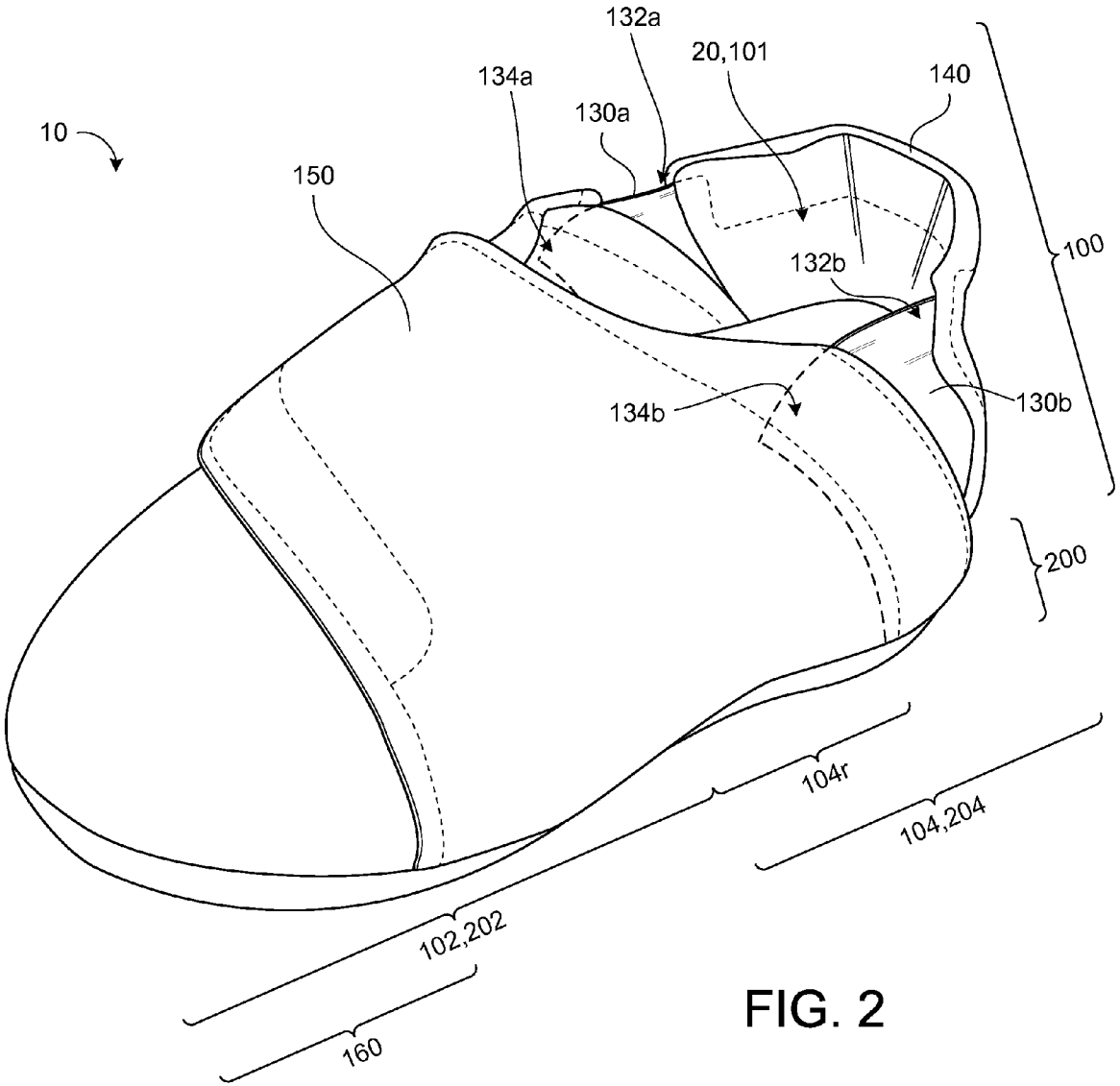
FIG. 2 is front perspective view of the article of footwear shown in FIG. 1 with the heel portion expander in an expanded state.
Figure 3:
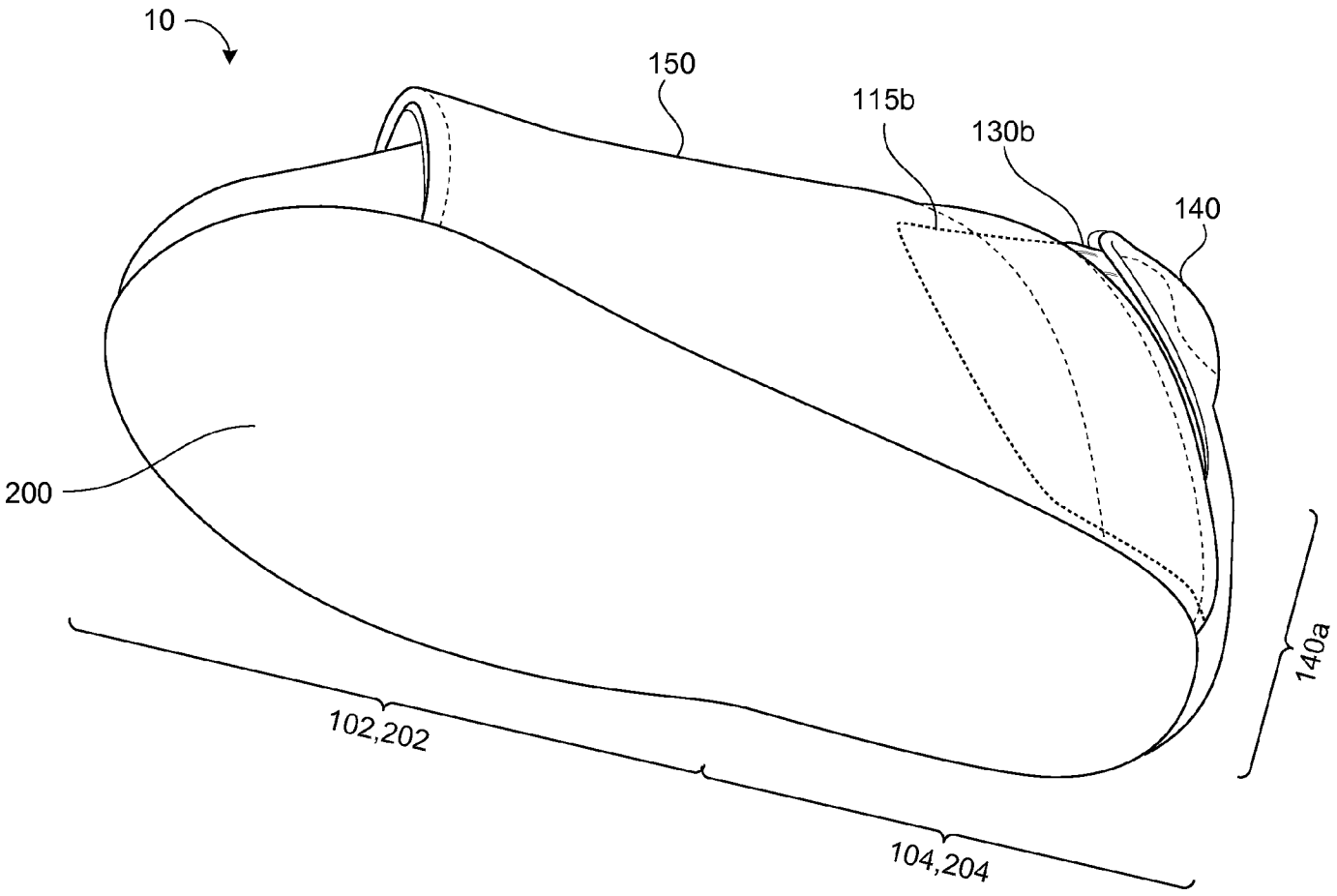
FIG. 3 is rear perspective view of the article of footwear shown in FIG. 1 with the heel portion expander in an unexpanded state.
Figure 4:
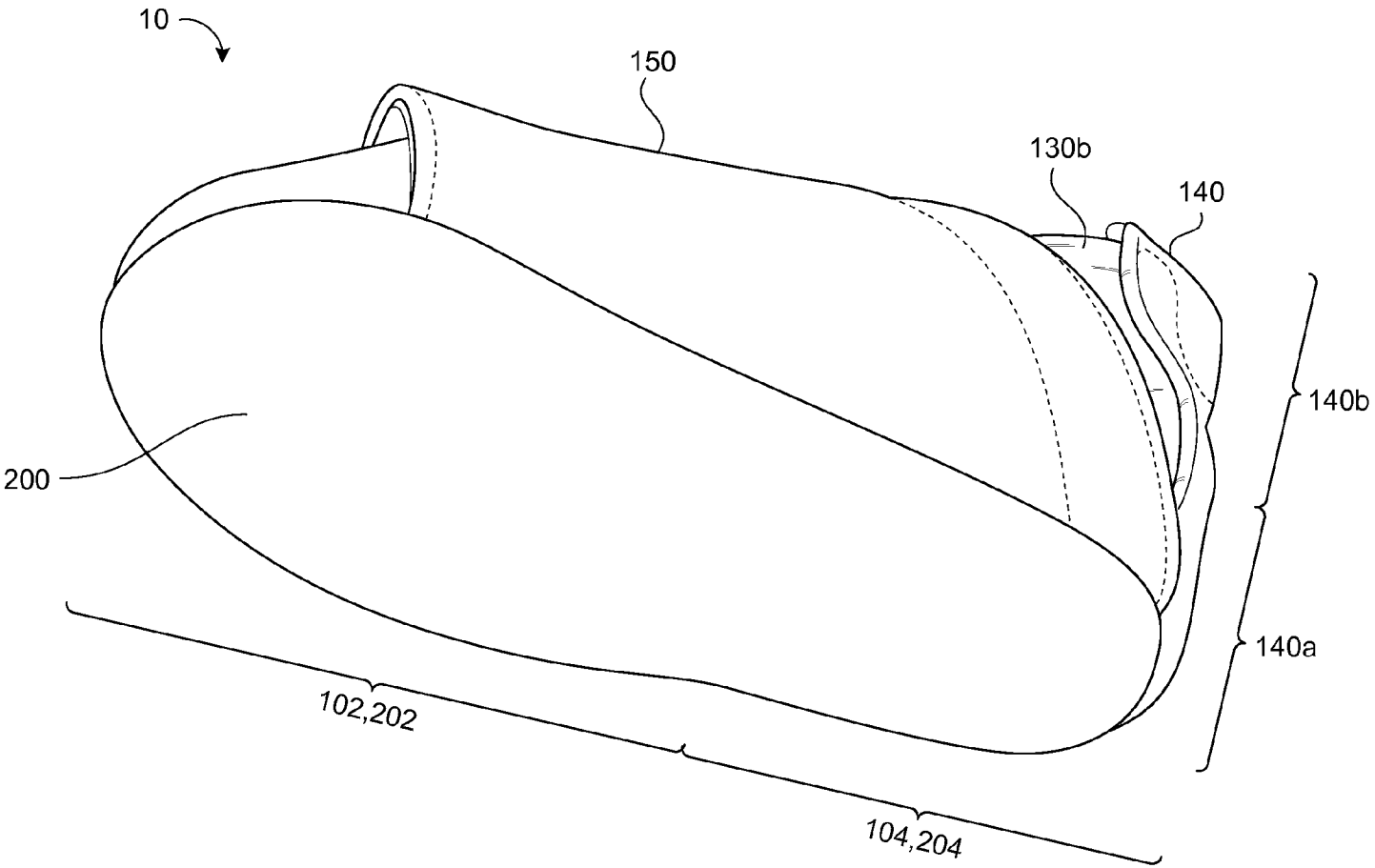
FIG. 4 is rear perspective view of the article of footwear shown in FIG. 1 with the heel portion expander in an expanded state.

In some implementations, the lateral expander 130*a* has a first end 132*a* attached to a lateral heel portion 104*l* of the upper 100 and a second end 134*a* attached to the heel cap 140. The medial expander 130*b* has a first end 132*b* attached to a medial heel portion 104*m* of the upper 100 and a second end 134*b* attached to the heel cap 140. Each expander independently moves between a relaxed state and a stretched state to accommodate receipt of the infant foot. In the example shown, the lateral and medial heel portions 104*l*, 104*m* of the upper 100 receive the second end portions 134*a*, 134*b* of the expanders 130*a*, 130*b* in corresponding lateral and medial pockets 115*a*, 115*b* defined between the outer and inner layers 110, 120 of the upper 100. The pockets 115*a*, 115*b* may completely or substantially completely receive and conceal the respective expanders 130*a*, 130*b* in their relaxed states. As a result, the heel cap 140 abuts or nearly abuts the remaining heel portion 104*r* when the expanders 130*a*, 130*b* are in their relaxed states, as shown in FIGS. 1 and 3. As the expanders 130*a*, 130*b* move to their stretched states from their relaxed state when the article of infant footwear 10 is donned by an infant foot, the expanders 130*a*, 130*b* stretch or elongate out of the pockets 115*a*, 115*b*, as shown in FIGS. 2 and 4. Other arrangements are possible as well.

In some implementations, a lower end portion 140*a* of the heel cap 140 connects to the sole 200 (e.g., by stitching and/or an adhesive), allowing the heel end to pivot about its lower end portion 140*a*. In other implementations, the lower end portion 140*a* of the heel cap 140 moves freely relative to the sole 200. Additionally or alternatively, lower and upper portions 140, 140*b* of the heel cap 140 may move freely relative to the remaining heel portion 104*r* of the upper 100.

Figure 5:
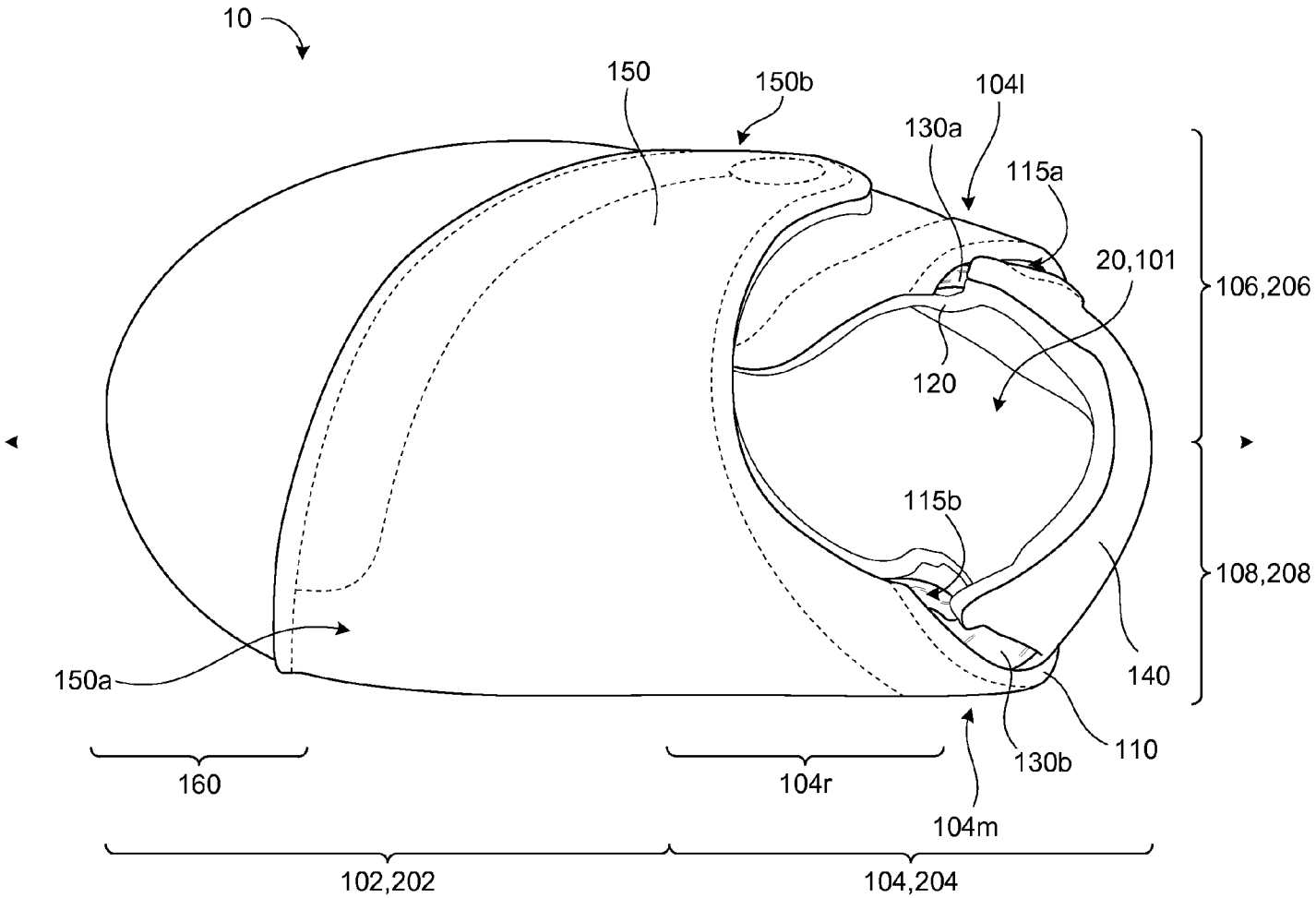
FIG. 5 is a top view of the article of footwear shown in FIG. 1 with a closure in a closed position.
Figure 6:
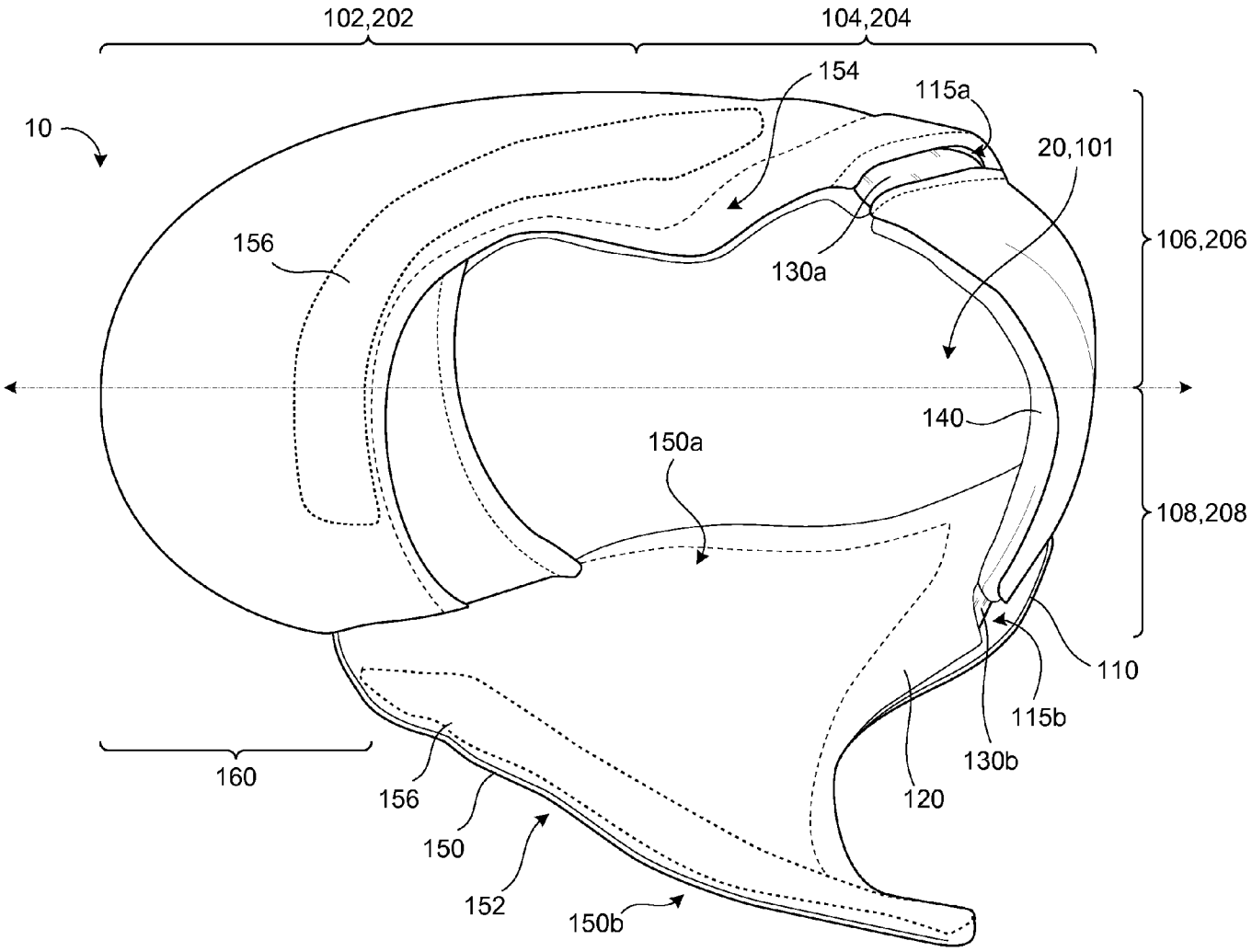
FIG. 6 is a top view of the article of footwear shown in FIG. 1 with the closure in an open position.
Figure 7:
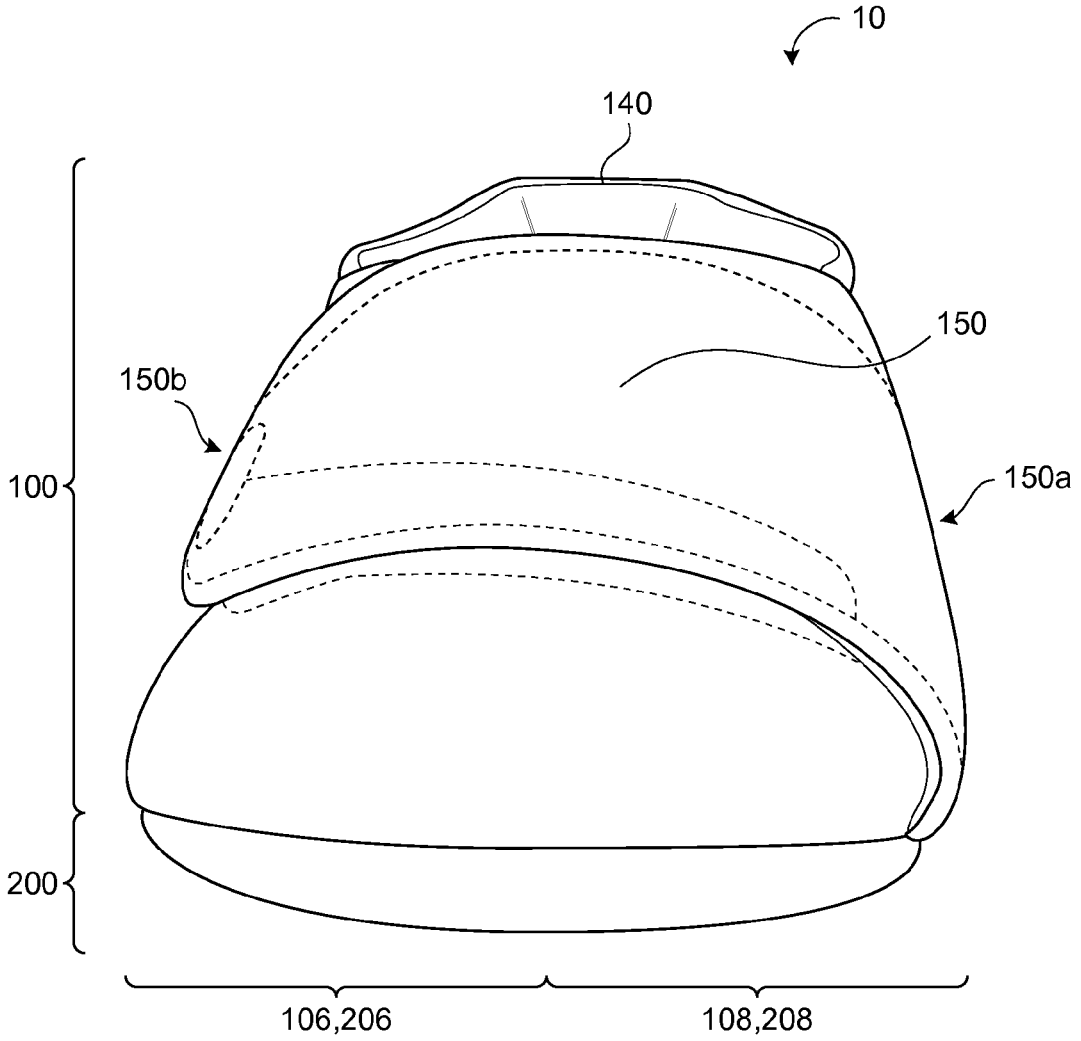
FIG. 7 is a front view of the article of footwear shown in FIG. 1.

Referring to FIGS. 5-7, in some implementations, the article of infant footwear 10 includes a closure 150 having a first end portion 150*a* secured to or extending from one of the lateral and medial portions 106, 108 of the upper 100 and a free second end portion 150*b* releasably securable to the other of the lateral and medial heel portions 106, 108 of the upper 100. In the example shown, the first closure end portion 150*a* is attached to the medial upper portion 106 and the second closure end portion 150*b* can releasably attaches to the lateral upper portion 108. The closure 150 moves between an open position exposing the void 20 defined by the upper 100 and the sole 200, and a closed position for securing a received foot in the void 20. The closure 150 securely holds a received infant foot in the void 20 by providing a swaddling effect over the foot.

Referring to FIG. 6, in some implementations, the closure 150 includes first and second flaps 152, 154. The first flap 152 extends from one of the lateral portion and medial portions 106, 108 of the upper 100, and the second flap 154 extends from the other of the lateral and medial portions 106, 108 of the upper 100. The first and second flaps 152, 154 overlap of the bridge of the received infant foot and releasably attach to each other for securing the received infant foot. The flaps 152, 154 swaddle the received foot to provide a comfortable, soft fit. At least one of the flaps 152, 154 extends between the foot opening 101 defined by the upper 100 and a toe box portion 160 of the upper 100. The toe box portion 160 is the portion of the upper forefoot that covers the toes of the infant foot. At least one of the flaps 152, 154 may define an arcuate shape in one or more directions to facilitate the overlapping swaddling of the two flaps 152, 154.

In the examples shown, hook and loop fasteners 156 releasably secure the closure 150 to the upper 100; however, other types of fasteners for the closure 150 may include, but are not limited to, zippers, buttons, low profile hook and loop, and snaps.

The sole 200 may be made of a flexible, compliant layer of material that moves with the received foot, such as leather and/or a fabric. In some implementations, the sole 200 includes one or more fabric or leather layers to allow flexible, compliant motion of the infant foot and to promote proprioceptive feedback from ground contact forces received through the sole 200. The flexible, compliant material has a thickness between about 1 mm and about 3 mm.

A number of implementations have been described. Nevertheless, it will be understood that various modifications may be made without departing from the spirit and scope of the disclosure. Accordingly, other implementations are within the scope of the following claims.

What is claimed is:

1. An article of infant footwear comprising:

a sole comprising a flexible, compliant layer of material having a thickness of between about 1 mm and about 3 mm;

an upper attached to the sole, the upper and the sole together defining a void to receive an infant foot, the upper having a heel cap independently movable relative to a remaining portion of the upper, the heel cap having a lower end pivotally connected to the sole, so that the heel cap is configured to pivot toward and away from the remaining portion of the upper; and elastic lateral and medial expanders, the lateral expander having a first end attached to a lateral heel portion of the upper and a second end attached to the heel cap, the medial expander having a first end attached to a medial heel portion of the upper and a second end attached to the heel cap, each expander independently moving between a relaxed state and a stretched state to accommodate receipt of the infant foot, wherein the heel cap abuts the remaining portion of the upper and the expanders are substantially completely concealed when the expanders are in the relaxed state.

2. The article of infant footwear of claim 1, wherein the upper defines lateral and medial pockets in the corresponding lateral and medial heel portions of the upper, the pockets arranged to receive the corresponding lateral and medial expanders.

3. The article of infant footwear of claim 2, wherein each pocket substantially completely receives the corresponding expander when the corresponding expander is in the relaxed state.

4. The article of infant footwear of claim 2, wherein each expander moves out of its corresponding pocket when each expander moves from the relaxed state to the stretched state.

5. The article of infant footwear of claim 1, wherein lateral and medial expanders are joined with a lateral and a medial forward edge, respectively, of the heel cap facing toward the remaining portion of the upper, wherein the forward edge is closer to the remaining portion of the upper at an upper end of the heel cap than at the lower end of the heel cap when the expanders are in the expanded state.

6. The article of infant footwear of claim 1, wherein the heel cap includes an upper end, wherein the upper end moves relative to the sole when the expanders go from the relaxed state to the stretched state, wherein the lower end is fixed, but pivotal, relative to the sole.

7. The article of infant footwear of claim 1, comprising a closure having a first end attached to one of a lateral portion and a medial portion of the upper and a free second end releasably secured to the other of the lateral and medial portions of the upper, the closure moving between an open position exposing the void defined by the upper and the sole and a closed position for securing the received infant foot in the void, wherein the closure continuously spans from the lateral portion across a bridge of the infant foot and to the medial portion, so as to contact the bridge of the infant foot when the closure is in the closed position.

8. The article of infant footwear of claim 7, comprising hook and loop fasteners arranged for releasably securing the closure.

9. The article of infant footwear of claim 1 comprising a first closure flap extending from the medial portion and a second closure flap extending from the lateral portion, the second closure flap traversing a bridge of the infant foot and releasably secured at an end to the first closure flap adjacent the medial portion.

10. An upper for an article of infant footwear, the upper comprising:

a heel cap independently movable relative to a remaining portion of the upper, the heel cap pivotable about a lower end of the heel cap;

elastic lateral and medial expanders, the lateral expander having a first end attached to a lateral heel portion of the upper and a second end attached to the heel cap, the medial expander having a first end attached to a medial heel portion of the upper and a second end attached to the heel cap, each expander independently moving between a relaxed state and a stretched state to accommodate receipt of an infant foot; and a closure having a first flap and a second flap, the first flap extending from one of a lateral portion and a medial portion of the upper, and the second flap extending from the other of the lateral and medial portions of the upper, the first and second flaps overlapping and releasably attaching to each other for securing the received infant foot, wherein the heel cap abuts a remaining portion of the upper and the expanders are substantially completely concealed when the expanders are in the relaxed state.

11. The upper of claim 10, wherein the upper defines lateral and medial pockets in the corresponding lateral and medial heel portions of the upper, the pockets arranged to receive the corresponding lateral and medial expanders.

12. The upper of claim 11, wherein each pocket substantially fully receives the corresponding expander in its relaxed state.

13. The upper of claim 11, wherein each expander moves out of its corresponding pocket when each expander moves from the relaxed state to the stretched state.

14. The upper of claim 11, comprising an outer layer disposed on an inner layer, the inner and outer layers defining the lateral and medial pockets the pockets extending from adjacent the sole to a location above an uppermost edge of the lateral and medial expanders.

15. The upper of claim 10, wherein upper and lower portions of the heel cap move freely relative to the remaining portion of the upper.

16. The upper of claim 10, wherein the first and second flaps overlap in a swaddling configuration.

17. The upper of claim 16, comprising hook and loop fasteners arranged for releasably securing the first and second flaps of the closure together.

18. The upper of claim 10, wherein the first flap extends between a foot opening defined by the upper and a toe box portion of the upper, wherein the second flap extends up and over a bridge of the infant foot, wherein the first flap extends to the lateral expander, wherein the second flap extends to the medial expander.

* * * * *